US011834782B2

(12) United States Patent
Abe et al.

(10) Patent No.: US 11,834,782 B2
(45) Date of Patent: Dec. 5, 2023

(54) SHEET MANUFACTURING APPARATUS

(71) Applicant: SEIKO EPSON CORPORATION, Tokyo (JP)

(72) Inventors: Takashi Abe, Yamagata (JP); Makoto Sato, Nagano (JP); Koji Motohashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 630 days.

(21) Appl. No.: 17/005,505

(22) Filed: Aug. 28, 2020

(65) Prior Publication Data

US 2021/0062415 A1 Mar. 4, 2021

(30) Foreign Application Priority Data

Aug. 30, 2019 (JP) ..... 2019-158892

(51) Int. Cl.
*D21B 1/10* (2006.01)
*D21B 1/06* (2006.01)

(52) U.S. Cl.
CPC ..... *D21B 1/061* (2013.01)

(58) Field of Classification Search
CPC ..... D21F 9/00; D21B 1/063
USPC ..... 162/13
See application file for complete search history.

(56) References Cited

U.S. PATENT DOCUMENTS

| | | | | |
|---|---|---|---|---|
| 9,982,391 | B2 | 5/2018 | Fujita | |
| 10,100,466 | B2 | 10/2018 | Gomi et al. | |
| 2016/0258112 | A1* | 9/2016 | Gomi | D21F 9/00 |
| 2019/0264391 | A1 | 8/2019 | Abe | |

FOREIGN PATENT DOCUMENTS

| | | | |
|---|---|---|---|
| CN | 110205849 | A | 9/2019 |
| JP | S50-069306 | A | 6/1975 |
| JP | 2016-112740 | A | 6/2016 |
| JP | 2016-113711 | A | 6/2016 |
| JP | 2016-113712 | A | 6/2016 |
| JP | 2016-113735 | A | 6/2016 |
| JP | 2016-160561 | A | 9/2016 |
| JP | 2016-163944 | A | 9/2016 |

* cited by examiner

*Primary Examiner* — Jacob T Minskey
(74) *Attorney, Agent, or Firm* — Global IP Counselors, LLP

(57) ABSTRACT

A sheet manufacturing apparatus includes: a raw material supplying section; a first coarse crushing section; a defibrating section; a deposition section; a heating and pressing section; a cutting section; and an ejection section.

8 Claims, 5 Drawing Sheets

SHEET MANUFACTURING APPARATUS

The present application is based on, and claims priority from JP Application Serial Number 2019-158892, filed Aug. 30, 2019, the disclosure of which is hereby incorporated by reference herein in its entirety.

BACKGROUND

1. Technical Field

Embodiments of the present disclosure relate to a sheet manufacturing apparatus.

2. Related Art

Recently, sheet manufacturing apparatuses based on a dry method, in which the use of water is minimized as much as possible, have been proposed as disclosed in JP-A-50-69306. The sheet manufacturing apparatus disclosed in JP-A-50-69306, for example, includes a turbo cutter, a turbo mill that performs dry defibration, adjustment, and mixing, a cyclone that removes foreign objects, a screen for removing yet-to-be-defibrated fibers, etc., a sheet forming apparatus that forms a sheet, a pickup apparatus, a smooth press, a drier, and a pope reel from which the manufactured sheet goes out. In the sheet manufacturing apparatus disclosed in JP-A-50-69306, when viewed in a vertical direction, these units are arranged in a row.

In the sheet manufacturing apparatus disclosed in JP-A-50-69306, the turbo cutter, to which the raw material is supplied, and the pope reel, from which the sheet goes out, are located on respective sides that are the opposite of each other. That is, in the sheet manufacturing apparatus disclosed in JP-A-50-69306, the raw material is supplied from one side, and the manufactured sheet goes out on the opposite side.

However, the overall length of the sheet manufacturing apparatus disclosed in JP-A-50-69306 is long because the processing units are arranged in a row. Therefore, when the apparatus is installed in a limited space, for example, an indoor space, the available space might not be enough for installation.

SUMMARY

A certain aspect of the present disclosure can be implemented as follows.

A sheet manufacturing apparatus according to a certain aspect of the present disclosure includes a raw material supplying section that supplies a raw material sheet that contains fibers; a first coarse crushing section that includes a first coarse crushing blade configured to rotate, and coarsely crushes the raw material sheet supplied from the raw material supplying section; a defibrating section that defibrates coarse crushed pieces produced by the first coarse crushing section; a deposition section on which a defibrated material produced by the defibrating section is deposited; a heating and pressing section that applies heat and pressure to a deposited material produced on the deposition section for forming into a sheet; a cutting section that cuts the sheet; and an ejection section that ejects the cut sheet; wherein when an x axis and a y axis which are orthogonal to each other and each of which is orthogonal to a vertical direction are set, the raw material supplying section and the ejection section are provided on one side in a direction of the x axis, a rotation axis of the first coarse crushing blade is along the y axis, and the raw material supplying section is disposed below the ejection section in the vertical direction, and the first coarse crushing section is disposed below the cutting section in the vertical direction.

DESCRIPTION OF EXEMPLARY EMBODIMENTS

Based on a certain non-limiting advantageous embodiment illustrated in the accompanying drawings, a sheet manufacturing apparatus according to the present disclosure will now be explained in detail.

Exemplary Embodiment

Figure 1:
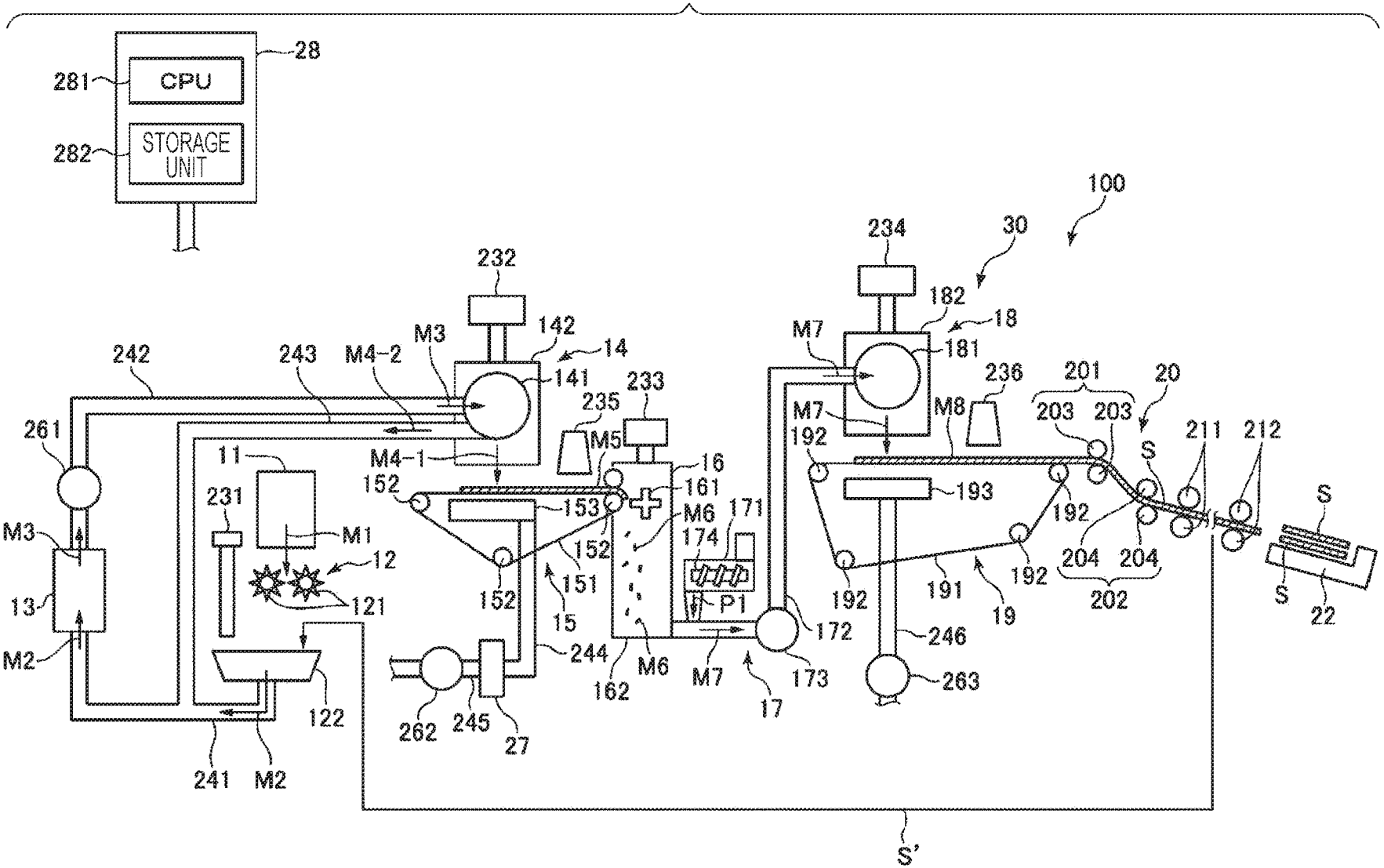
FIG. 1 is a schematic side view of a sheet manufacturing apparatus according to an exemplary embodiment.
Figure 2:
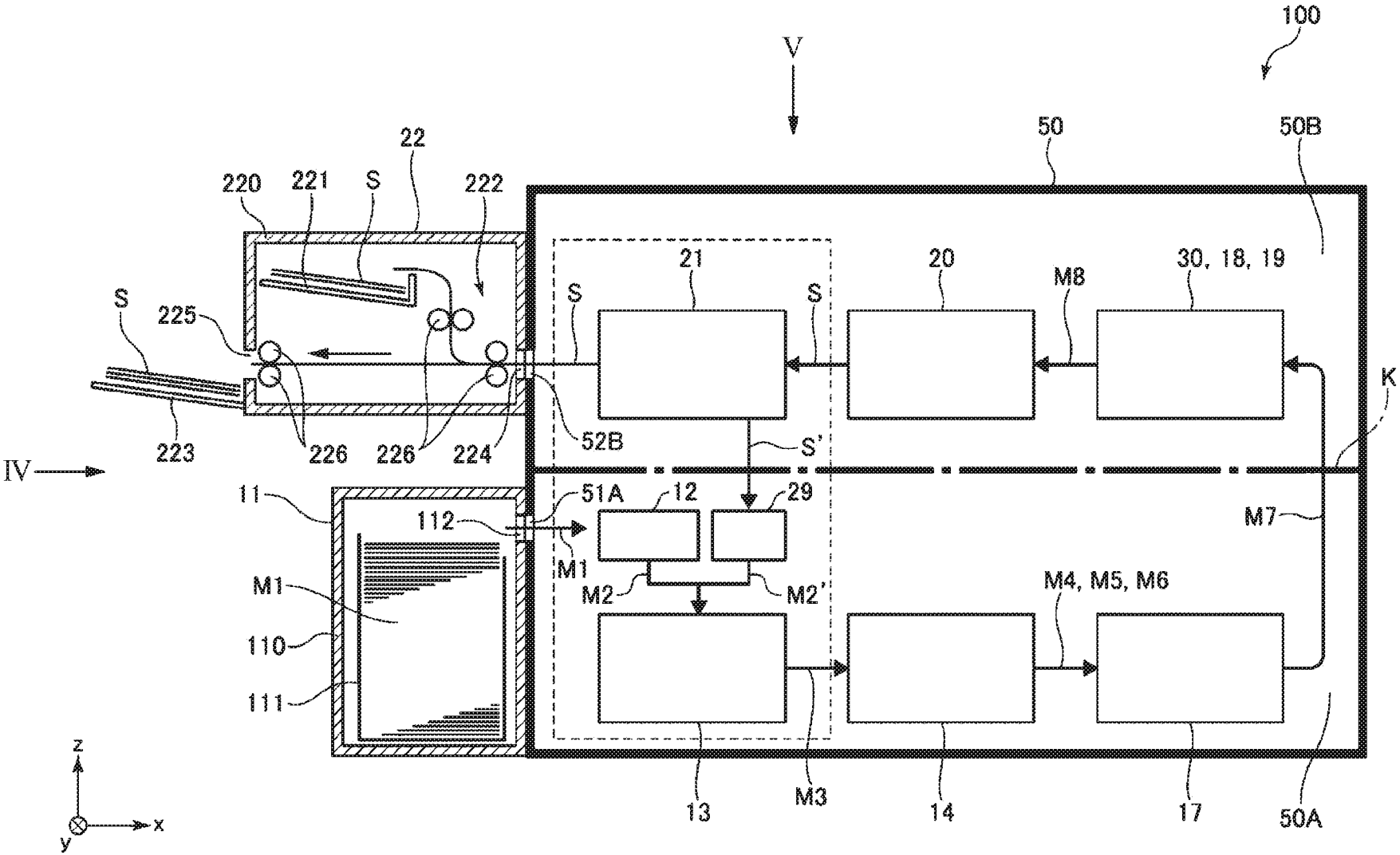
FIG. 2 is a schematic diagram illustrating a positional relationship among units of the sheet manufacturing apparatus illustrated in FIG. 1.
Figure 3:
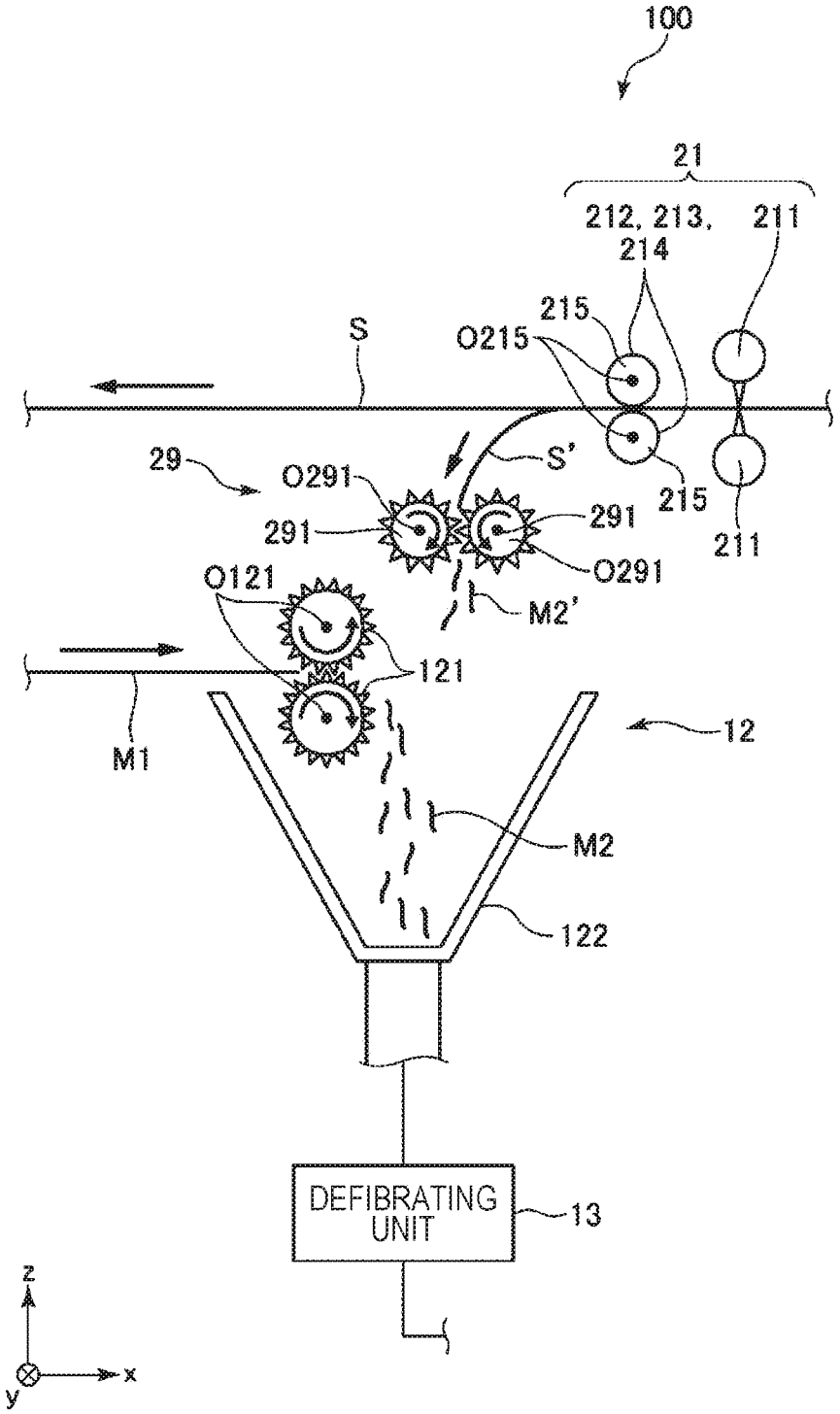
FIG. 3 is an enlarged view of an area enclosed by a broken-line box in FIG. 2.
Figure 4:
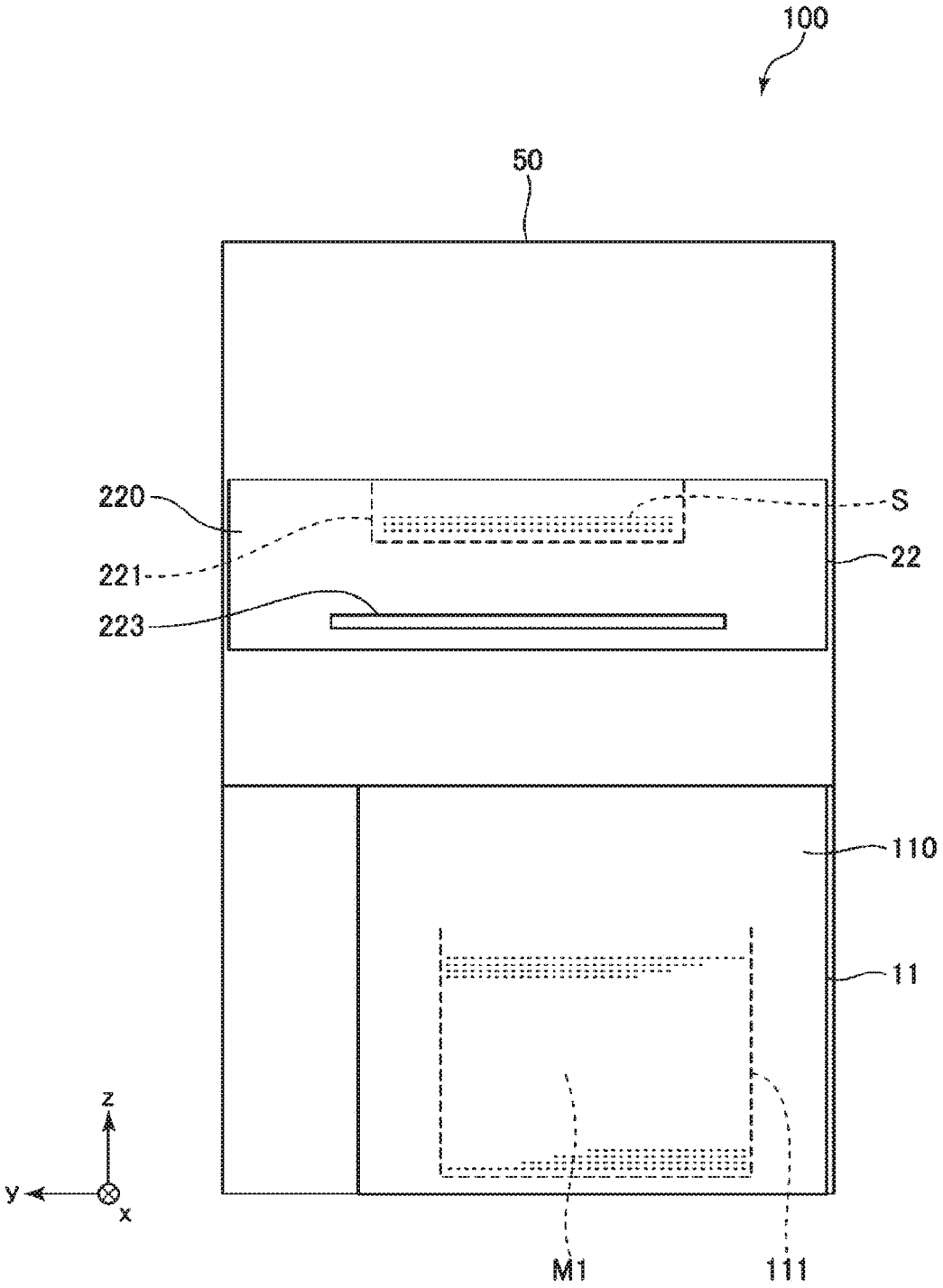
FIG. 4 is a view taken along a direction indicated by an arrow IV in FIG. 2.
Figure 5:
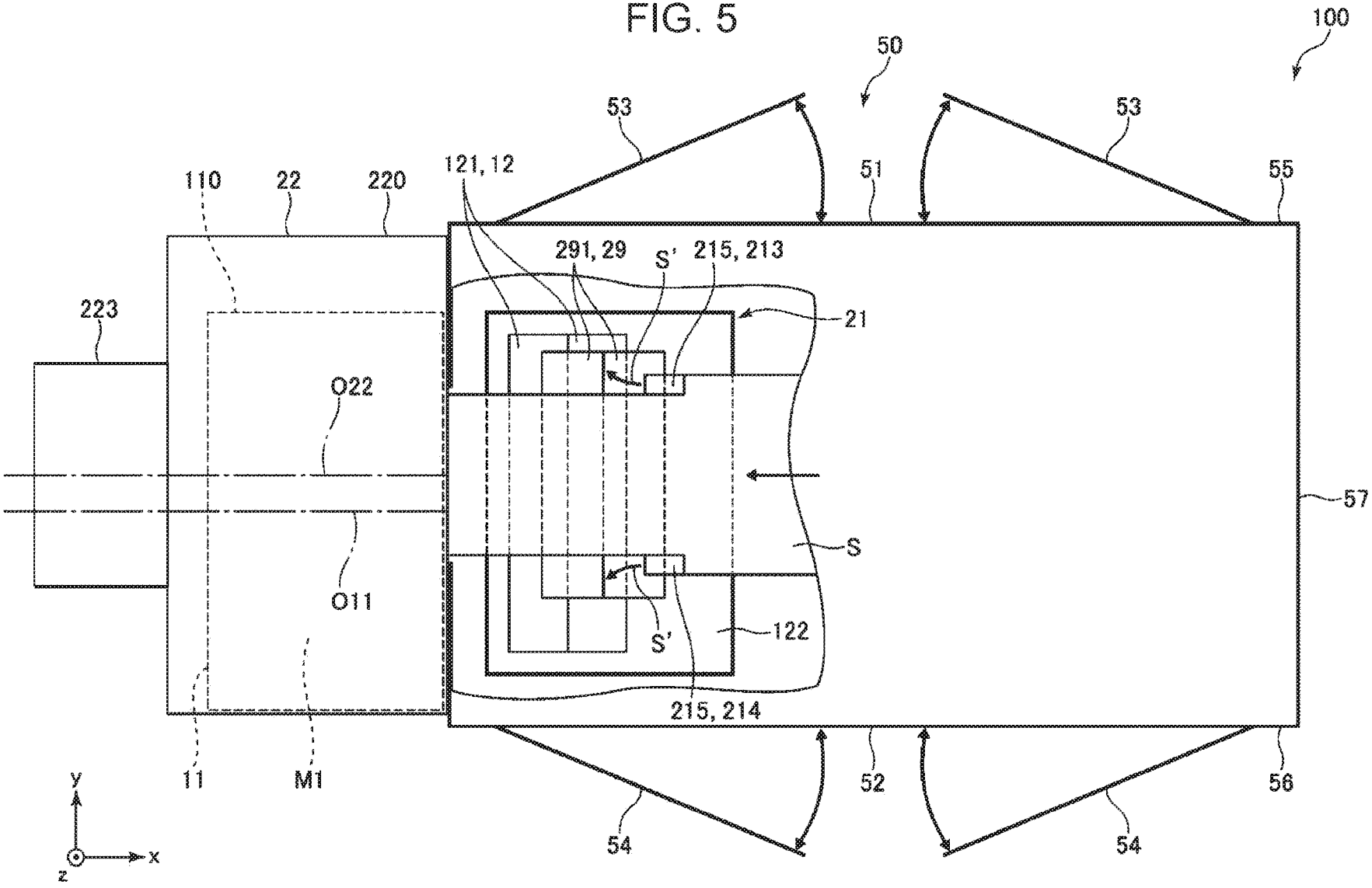
FIG. 5 is a view taken along a direction indicated by an arrow V in FIG. 2.

FIG. 1 is a schematic side view of a sheet manufacturing apparatus according to an exemplary embodiment. FIG. 2 is a schematic diagram illustrating a positional relationship among units of the sheet manufacturing apparatus illustrated in FIG. 1. FIG. 3 is an enlarged view of an area enclosed by a broken-line box in FIG. 2. FIG. 4 is a view taken along a direction indicated by an arrow IV in FIG. 2. FIG. 5 is a view taken along a direction indicated by an arrow V in FIG. 2.

In the description below, in order to facilitate an explanation, three axes orthogonal to one another are set as the x axis, the y axis, and the z axis as shown in FIGS. 2 to 5. The x-y plane including the x axis and the y axis is horizontal. The z axis is vertical. The direction indicated by the head of an arrow on each axis is denoted as "+". The opposite direction is denoted as "−". An upper position in FIGS. 1 to 4 may be referred to as "above/over" or "upper", and a lower position therein may be referred to as "below/under" or "lower".

In this specification, the term "horizontal" is not limited to a case of perfect horizontalness. The term "horizontal" encompasses cases of inclination within a range of ±5° with respect to horizontalness. Similarly, in this specification, the term "vertical" is not limited to a case of perfect verticalness. The term "vertical" encompasses cases of inclination within a range of ±5° with respect to verticalness.

FIG. 1 is a schematic view prepared for making it easier to understand a series of processes for manufacturing a sheet S from a raw material sheet M1. Therefore, a positional relationship among units of a sheet manufacturing apparatus 100 illustrated in FIG. 1 is significantly different from an actual positional relationship. An overall structure of the sheet manufacturing apparatus 100 will now be explained first.

As illustrated in FIGS. 1 and 5, the sheet manufacturing apparatus 100 includes a raw material supplying unit 11, a first coarse crushing unit 12, a defibrating unit 13, a screening unit 14, a first web forming unit 15, a fragmenting unit 16, a mixing unit 17, a disentangling unit 18, a second web forming unit 19, a heating and pressing unit 20, a cutting unit 21, an ejection unit 22, a second coarse crushing unit 29, a collection unit 27, a control unit 28, and a casing 50. The disentangling unit 18 and the second web forming unit 19 constitute a deposition unit 30. These units are housed inside the casing 50 as illustrated in FIG. 2, except for the raw material supplying unit 11 and the ejecting unit 22. The control unit 28 may be housed inside the casing 50 or provided externally.

As illustrated in FIG. 2, the casing 50 has an inlet port 51A, through which a raw material sheet M1 is fed in, and an outlet port 52B, through which a sheet S goes out. The raw material sheet M1 supplied from the raw material supplying unit 11 is fed into the casing 50 through the inlet port 51A, and is formed into the sheet S by undergoing processes described below. The sheet S formed goes out through the outlet port 52B to the ejection unit 22 provided outside the casing 50.

Each of the raw material supplying unit 11, the first coarse crushing unit 12, the defibrating unit 13, the screening unit 14, the first web forming unit 15, the fragmenting unit 16, the mixing unit 17, the disentangling unit 18, the second web forming unit 19, the heating and pressing unit 20, the cutting unit 21, the ejection unit 22, the second coarse crushing unit 29, and the collection unit 27 is electrically coupled to the control unit 28. The operations of them are controlled by the control unit 28.

As illustrated in FIG. 1, the sheet manufacturing apparatus 100 further includes a humidifying unit 231, a humidifying unit 232, a humidifying unit 233, a humidifying unit 234, a humidifying unit 235, and a humidifying unit 236. In addition to those described above, the sheet manufacturing apparatus 100 includes a blower 261, a blower 262, and a blower 263.

The humidifying units 231 to 236 and the blowers 261 to 263 are electrically coupled to the control unit 28. The operations of them are controlled by the control unit 28.

In the sheet manufacturing apparatus 100, a raw material supplying process, a first coarse crushing process, a defibrating process, a screening process, a first web forming process, a fragmenting process, a mixing process, a disentangling process, a second web forming process, a heat and pressure applying process, a cutting process, a second coarse crushing process, and an ejection process are performed in this order. The second coarse crushing process and the ejection process may be performed at the same time. The second coarse crushing process may be performed before the ejection process. The ejection process may be performed before the second coarse crushing process.

The structure of each unit will now be explained.

As illustrated in FIGS. 1 and 2, the raw material supplying unit 11 is a section that performs a raw material supplying process of supplying the raw material sheet M1 to the first coarse crushing unit 12. An example of the material of the raw material sheet M1 is a sheet-like material made of a fiber-containing body containing a cellulose fiber. The cellulose fiber may be any fibrous material containing cellulose as a main compound, and may contain hemicellulose or lignin in addition to cellulose. The form of the raw material sheet M1 is not limited, such as woven fabric or non-woven fabric. The raw material sheet M1 may be, for example, recycled paper reproduced by defibrating used paper or synthetic YUPO paper (registered trademark), or may be non-recycled paper. In the present embodiment, the raw material sheet M1 is waste paper that has been used or is no longer needed.

As illustrated in FIG. 2, the raw material supplying unit 11 includes a casing 110, a stock unit 111 that is housed inside the casing 110, and a feeder mechanism that is not illustrated. The casing 110 is disposed outside the casing 50, specifically, adjacently on the −x side. The casing 110 is fixed to the −x sidewall of the casing 50, that is, the sidewall located on the −x side. The casing 110 has an outlet port 112 which is provided in its +x sidewall and through which the raw material sheet M1 is fed out.

The stock unit 111 is a section in which raw material sheets M1 are stacked in the +z direction and stored. The raw material sheets M1 stored in the stock unit 111 are fed out of the stock unit 111 by the non-illustrated feeder mechanism on a sheet-after-sheet basis. The raw material sheet M1 fed out is sent into the casing 50, specifically, to the first coarse crushing unit 12, through the outlet port 112 and the inlet port 51A. The feeder mechanism is not specifically limited. For example, a feeder roller, etc. can be used.

The first coarse crushing unit 12 is a section that performs a first coarse crushing process of coarsely crushing the raw material sheet M1 supplied from the raw material supplying unit 11 in air such as atmospheric conditions. The first coarse crushing unit 12 includes a pair of first coarse crushing blades 121 and a chute 122.

As illustrated in FIG. 3, the pair of first coarse crushing blades 121 each rotates around its rotation axis O121 extending in the y direction. Each of the first coarse crushing blades 121 has a shape of a round column or a cylinder extending in the y direction. By rotating in respective directions that are the opposite of each other, the pair of first coarse crushing blades 121 is able to coarsely crush, that is, shred, the raw material sheet M1 therebetween into coarse crushed pieces M2. It will be advantageous if the coarse crushed piece M2 has a shape and size suitable for defibration by the defibrating unit 13. For example, the length of a side of the small piece may be 100 mm or less. The length of a side of the small piece may be 10 mm or more and 70 mm or less.

Since each of the first coarse crushing blades 121 rotates around its rotation axis O121 extending in the y direction, it is possible to coarsely crush the raw material sheet M1 coming in the x direction without any change in course in the y direction.

The chute 122 is provided under the pair of first coarse crushing blades 121 and has a shape like, for example, a funnel. The chute 122 is able to receive the coarse crushed pieces M2 falling after the coarse crushing by the first coarse crushing blades 121.

As illustrated in FIG. 1, the humidifying unit 231 is provided next to the pair of first coarse crushing blades 121 over the chute 122. The humidifying unit 231 humidifies the coarse crushed pieces M2 in the chute 122. The humidifying unit 231 includes a non-illustrated filter containing moisture. The humidifying unit 231 is a warm-air-vaporization-type humidifier that supplies humidified air with increased humidity to the coarse crushed pieces M2 by passing air through the filter. Supplying humidified air to the coarse crushed pieces M2 makes it possible to prevent the static cling of the coarse crushed pieces M2 to the chute 122 and the like.

The chute 122 is connected to the defibrating unit 13 via a pipe 241. The coarse crushed pieces M2 gathered into the chute 122 are transported to the defibrating unit 13 through the pipe 241.

The defibrating unit 13 is a section that performs a defibrating process of defibrating the coarse crushed pieces M2 in air, which means dry defibration. It is possible to produce a defibrated material M3 from the coarse crushed pieces M2 through the defibrating process performed by the defibrating unit 13. The term "defibration" means the disentanglement of the coarse crushed pieces M2 made of plural fibers bonded to one another into individual fibers. The result of the disentanglement is the defibrated material M3. The defibrated material M3 has a string shape or a ribbon shape. The defibrated material M3 may be in a state of so-called "lumps", in which defibrated fibers are intertwined with one another in an agglomerated manner.

The defibrating unit 13 is, for example, in the present embodiment, an impeller mill that includes rotary blades that rotate at a high speed and a liner that is located in the outer circumference of the rotary blades. The coarse crushed pieces M2 that have flowed into the defibrating unit 13 go into the gap between the rotary blades and the liner and are defibrated.

By rotation of the rotary blades, the defibrating unit 13 is able to produce the flow of air, that is, airflow from the first coarse crushing unit 12 toward the screening unit 14. By this means, it is possible to suck the coarse crushed pieces M2 into the defibrating unit 13 through the pipe 241. After the defibration, it is possible to send the defibrated material M3 to the screening unit 14 through a pipe 242.

The blower 261 is provided between the ends of the pipe 242. The blower 261 is an airflow generator that generates airflow toward the screening unit 14. This promotes the delivery of the defibrated material M3 to the screening unit 14.

The screening unit 14 is a section that performs a screening process of screening the defibrated material M3 according to the lengths of fibers. In the screening unit 14, the defibrated material M3 is sorted into a first screened material M4-1 and a second screened material M4-2, which is larger than the first screened material M4-1. The first screened material M4-1 has a size suitable for the subsequent manufacture of a sheet S. The average length may be 1 μm or more and 30 μm or less. The second screened material M4-2 contains, for example, insufficiently defibrated fibers, excessive agglomeration of defibrated fibers, and the like.

The screening unit 14 has a drum portion 141 and a housing portion 142, which houses the drum portion 141.

The drum portion 141 is a sieve that is has a cylindrical net structure and rotates around its central axis. The defibrated material M3 flows into the drum portion 141. By rotation of the drum portion 141, the defibrated material M3 that is smaller than the mesh of the net is sorted as the first screened material M4-1, and the defibrated material M3 that is larger than the mesh of the net is sorted as the second screened material M4-2. The first screened material M4-1 falls from the drum portion 141.

On the other hand, the second screened material M4-2 is sent to a pipe 243 connected to the drum portion 141. The pipe 243 is connected to the pipe 241 at its end that is the opposite of an end connected to the drum portion 141, that is, the upstream end. The second screened material M4-2 that has flowed through the pipe 243 merges with the coarse crushed pieces M2 inside the pipe 241 and flows together with the coarse crushed pieces M2 into the defibrating unit 13. By this means, the second screened material M4-2 is returned to the defibrating unit 13 and is subjected to defibration again together with the coarse crushed pieces M2.

The first screened material M4-1 falls from the drum portion 141 while being dispersed in air and travels toward the first web forming unit 15, which is located under the drum portion 141. The first web forming unit 15 is a section that performs a first web forming process of forming a first web M5 from the first screened material M4-1. The first web forming unit 15 includes a mesh belt 151, three stretching rollers 152, and a suction unit 153.

The mesh belt 151 is an endless belt, and the first screened material M4-1 is deposited thereon. The mesh belt 151 is stretched around the three stretching rollers 152. The first screened material M4-1 on the mesh belt 151 is transported downstream by the rotation of the stretching rollers 152.

The first screened material M4-1 has a size larger than the mesh of the mesh belt 151. Therefore, the first screened material M4-1 is unable to pass through the mesh belt 151. This ensures deposition on the mesh belt 151. The first screened material M4-1 is deposited on the mesh belt 151 and is transported downstream together with the mesh belt 151. Therefore, the first web M5 that has a layer shape is formed.

There is a possibility that the first screened material M4-1 contains, for example, dust or dirt particles. Dust and dirt particles come from, for example, coarse crushing or defibration. Dust and dirt particles are collected into the collection unit 27 described later.

The suction unit 153 is a suction mechanism that sucks air from below the mesh belt 151. By this means, it is possible to suck dust and dirt that has passed through the mesh belt 151, together with air.

The suction unit 153 is connected to the collection unit 27 via a pipe 244. The dust and dirt particles sucked by the suction unit 153 are collected into the collection unit 27.

The collection unit 27 is further connected to a pipe 245. The blower 262 is provided between the ends of the pipe 245. By the operation of the blower 262, a suction force can be generated in the suction unit 153. This promotes the forming of the first web M5 on the mesh belt 151. The first web M5 is one from which dust and dirt particles have been removed. Dust and dirt particles flow through the pipe 244 to reach the collection unit 27 by the operation of the blower 262.

The housing portion 142 is connected to the humidifying unit 232. The humidifying unit 232 is a vaporizing humidifier, similarly to the humidifying unit 231. Therefore, humidified air is supplied into the housing portion 142. The humidified air humidifies the first screened material M4-1. This prevents the static cling of the first screened material M4-1 to the inner wall of the housing portion 142.

The humidifying unit 235 is provided downstream of the screening unit 14. The humidifying unit 235 is an ultrasonic humidifier that sprays water. Since moisture is supplied to the first web M5, the moisture content of the first web M5 is adjusted. The moisture adjustment prevents the static cling of the first web M5 to the mesh belt 151. Therefore, the first web M5 comes off easily from the mesh belt 151 at a position where the mesh belt 151 is turned back by the stretching roller 152.

The fragmenting unit 16 is provided downstream of the humidifying unit 235. The fragmenting unit 16 is a section that performs a fragmenting process, in which the first web M5 that has come off from the mesh belt 151 is fragmented. The fragmenting unit 16 includes a propeller 161 that is rotatably supported and a housing portion 162 that houses the propeller 161. By rotating the propeller 161, it is possible to fragment the first web M5. The first web M5 is broken into fragments M6. The fragments M6 drop inside the housing portion 162.

The housing portion 162 is connected to the humidifying unit 233. The humidifying unit 233 is a vaporizing humidifier, similarly to the humidifying unit 231. Therefore, humidified air is supplied into the housing portion 162. The humidified air prevents the static cling of the fragments M6 to the propeller 161 or the inner wall of the housing portion 162.

The mixing unit 17 is provided downstream of the fragmenting unit 16. The mixing unit 17 is a section that performs a mixing process of mixing the fragments M6 with a resin P1. The mixing unit 17 includes a resin supplying portion 171, a pipe 172, and a blower 173.

The pipe 172, through which a mixture M7 of the fragments M6 and the resin P1 flows, connects the housing portion 162 of the fragmenting unit 16 and a housing portion 182 of the disentangling unit 18.

The resin supplying portion 171 is connected between the ends of the pipe 172. The resin supplying portion 171 includes a screw feeder 174. By rotation of the screw feeder 174, it is possible to supply the resin P1 that is in the form of powder or particles into the pipe 172. The resin P1 supplied into the pipe 172 is mixed with the fragments M6 to turn into the mixture M7.

The resin P1 binds fibers to one another in the subsequent processes. For example, a thermoplastic resin, a curable resin, or the like can be used as the resin P1. It will be advantageous to use a thermoplastic resin. Examples of the thermoplastic resin include an AS resin, an ABS resin, polyethylene, polypropylene, polyolefin such as an ethylene-vinyl acetate copolymer (EVA), modified polyolefin, an acrylic resin such as polymethyl methacrylate, polyvinyl chloride, polystyrene, polyester such as polyethylene terephthalate and polybutylene terephthalate, polyamide (nylon) such as nylon 6, nylon 46, nylon 66, nylon 610, nylon 612, nylon 11, nylon 12, nylon 6-12, and nylon 6-66, polyphenylene ether, polyacetal, polyether, polyphenylene oxide, polyetheretherketone, polycarbonate, polyphenylene sulfide, thermoplastic polyimide, polyetherimide, a liquid crystal polymer such as aromatic polyester, various thermoplastic elastomers such as a styrene-based thermoplastic elastomer, a polyolefin-based thermoplastic elastomer, a polyvinyl chloride-based thermoplastic elastomer, a polyurethane-based thermoplastic elastomer, a polyester-based thermoplastic elastomer, a polyamide-based thermoplastic elastomer, a polybutadiene-based thermoplastic elastomer, a trans polyisoprene-based thermoplastic elastomer, a fluoro rubber-based thermoplastic elastomer, and a chlorinated polyethylene-based thermoplastic elastomer, and the like. Any one selected from among those enumerated above, or a combination of two or more, may be used. Polyester or a composition containing the polyester may be used as the thermoplastic resin.

Besides the resin P1, for example, a colorant for coloring fibers, an aggregation inhibitor for inhibiting aggregation of fibers or aggregation of the resin P1, a flame retardant for making fibers difficult to burn, a paper strengthening agent for enhancing the strength of a sheet S, and the like may be included in an additive supplied from the resin supplying portion 171. Alternatively, a composite of the resin P1 containing any of them prepared in advance may be supplied from the resin supplying portion 171.

The blower 173 is provided downstream of the resin supplying portion 171 between the ends of the pipe 172. The fragments M6 and the resin P1 are mixed with each other by the action of the rotating portion such as blades of the blower 173. The blower 173 is able to generate airflow toward the disentangling unit 18. The airflow stirs the fragments M6 and the resin P1 inside the pipe 172. This makes it possible for the mixture M7 to flow into the disentangling unit 18 in a state in which the fragments M6 and the resin P1 are uniformly dispersed. The fragments M6 in the mixture M7 are disentangled in the process of flowing through the pipe 172, thereby turning into a finer fibrous form.

The disentangling unit 18 is a section that performs a disentangling process of disentangling fibers intertwined with one another in the mixture M7. The disentangling unit 18 has a drum portion 181 and a housing portion 182, which houses the drum portion 181.

The drum portion 181 is a sieve that is has a cylindrical net structure and rotates around its central axis. The mixture M7 flows into the drum portion 181. When the drum portion 181 rotates, in the mixture M7, fibers, etc. that are smaller than the mesh of the net are able to pass through the drum portion 181. In this process, the mixture M7 is disentangled.

The housing portion 182 is connected to the humidifying unit 234. The humidifying unit 234 is a vaporizing humidifier, similarly to the humidifying unit 231. Therefore, humidified air is supplied into the housing portion 182. The humidified air humidifies the inside of the housing portion 182. This prevents the static cling of the mixture M7 to the inner wall of the housing portion 182.

The mixture M7 disentangled in the drum portion 181 falls while being dispersed in air and travels toward the second web forming unit 19, which is located under the drum portion 181. The second web forming unit 19 is a section that performs a second web forming process of forming a second web M8 from the mixture M7. The second web forming unit 19 includes a mesh belt 191, stretching rollers 192, and a suction unit 193.

The mesh belt 191 is an endless belt, and the mixture M7 is deposited thereon. The mesh belt 191 is stretched around the four stretching rollers 192. The mixture M7 on the mesh belt 191 is transported downstream by the rotation of the stretching rollers 192.

The size of most of the mixture M7 on the mesh belt 191 is larger than the mesh of the mesh belt 191. Therefore, most of the mixture M7 is unable to pass through the mesh belt 191. This ensures deposition on the mesh belt 191. The mixture M7 is deposited on the mesh belt 191 and is transported downstream together with the mesh belt 191. Therefore, the second web M8 that has a layer shape is formed.

The suction unit 193 is a suction mechanism that sucks air from below the mesh belt 191. Therefore, it is possible to suck the mixture M7 onto the mesh belt 191, and the deposition of the mixture M7 on the mesh belt 191 is promoted.

A pipe 246 is connected to the suction unit 193. The blower 263 is provided between the ends of the pipe 246. By the operation of the blower 263, a suction force can be generated in the suction unit 193.

The disentangling unit 18 and the second web forming unit 19 described above constitute the deposition unit 30 on which the defibrated material M3 produced by the defibrating unit 13 is deposited.

The humidifying unit 236 is provided downstream of the disentangling unit 18. The humidifying unit 236 is an ultrasonic humidifier, similarly to the humidifying unit 235. Since moisture is supplied to the second web M8, the moisture content of the second web M8 is adjusted. The moisture adjustment prevents the static cling of the second web M8 to the mesh belt 191. Therefore, the second web M8 comes off easily from the mesh belt 191 at a position where the mesh belt 191 is turned back by the stretching roller 192.

The total moisture content added to the humidifying units 231 to 236 may be, for example, 0.5 parts by mass or more and 20 parts by mass or less with respect to 100 parts by mass of the material before humidification.

The heating and pressing unit 20 is provided downstream of the second web forming unit 19. The heating and pressing unit 20 is a section that performs a heating and pressing process to form a sheet S from the second web M8. The heating and pressing unit 20 includes a pressing portion 201 and a heating portion 202.

The pressing portion 201 includes a pair of calendar rollers 203 and is able to press the second web M8 between the calendar rollers 203 without heating. This increases the density of the second web M8. For example, the degree of pressing may be a degree that does not cause the melting of the resin P1. The second web M8 after the pressing is transported to the heating portion 202. One of the pair of calendar rollers 203 is a drive roller that is driven by the operation of a motor that is not illustrated, and the other is a driven roller.

The heating portion 202 includes a pair of heating rollers 204. It is possible to apply pressure while heating the second web M8 between the heating rollers 204. The heating and pressing causes the melting of the resin P1 in the second web M8, and fibers are bonded together by the molten resin P1. The sheet S is formed in this way. The sheet S is transported to the cutting unit 21. One of the pair of heating rollers 204 is a drive roller that is driven by the operation of a motor that is not illustrated, and the other is a driven roller.

The cutting unit 21 is provided downstream of the heating and pressing unit 20. The cutting unit 21 is a section that performs a cutting process of cutting the sheet S. The cutting unit 21 includes a first cutting portion 211 and a second cutting portion 212.

The first cutting portion 211 cuts the sheet S in a direction that intersects with the transport direction of the sheet S, in particular, a direction that is orthogonal thereto.

The second cutting portion 212 cuts the sheet S in a direction parallel to the transport direction of the sheet S downstream of the first cutting portion 211. This cutting is to remove unnecessary edge portions at both ends of the sheet S, that is, the ends in the +y direction and the −y direction as illustrated in FIGS. 3 and 5, to adjust the width of the sheet S properly. The cut and removed extra portion is called "waste edge" and is referred to as sheet S' in the description below.

As illustrated in FIG. 5, the second cutting portion 212 includes a first cutter unit 213, which cuts the +Y directional edge of the sheet S, and a second cutter unit 214, which cuts the −Y directional edge of the sheet S. The first cutter unit 213 and the second cutter unit 214 are arranged in this order from the +Y side at a predetermined distance from each other. The structure of the second cutter unit 214 is the same as the structure of the first cutter unit 213. Therefore, the first cutter unit 213 is taken as an example in the description below.

As illustrated in FIG. 3, the first cutter unit 213 includes two rotary blades 215. The two rotary blades 215 are arranged next to each other along the z axis, with the transportation path of the sheet S traversing therebetween. Each of the two rotary blades 215 has a disc shape and is oriented such that its thickness direction is along the y axis. The circumferential portion of the rotary blade 215 has a sharp cutter edge. It is possible to cut the sheet S in the x direction when the sheet S passes between the two rotary blades 215. The waste edge, that is, the sheet S', is formed as a result of the cutting. The sheet S' cut off by the second cutting portion 212 falls to be supplied to the second coarse crushing unit 29, which is located below the second cutting portion 212.

As explained above, the cutting unit 21 includes the first cutting portion 211, which cuts the sheet S along the y direction, and the second cutting portion 212, which cuts off the extra portion of the sheet S along the x direction. By this means, it is possible to adjust the size of the sheet S into a desired length and a desired width.

The second coarse crushing unit 29 is a section that performs a second coarse crushing process of coarsely crushing the sheet S' that falls from above in air such as atmospheric conditions. The second coarse crushing unit 29 includes a pair of second coarse crushing blades 291.

As illustrated in FIG. 3, the pair of second coarse crushing blades 291 each rotates around its rotation axis O291 extending in the y direction. Each of the second coarse crushing blades 291 has a shape of a round column or a cylinder extending in the y direction. By rotating in respective directions that are the opposite of each other, the pair of second coarse crushing blades 291 is able to coarsely crush, that is, shred, the sheet S' therebetween into coarse crushed pieces M2'. It will be advantageous if the coarse crushed piece M2' has a shape and size suitable for defibration by the defibrating unit 13. For example, the length of a side of the small piece may be 100 mm or less. The length of a side of the small piece may be 10 mm or more and 70 mm or less.

The coarse crushed pieces M2' produced by the second coarse crushing unit 29 in this way fall into the chute 122 and are then supplied to the defibrating unit 13. Therefore, it is possible to reuse, as the raw material, the extra portion of the sheet S produced due to size adjustment. This is advantageous in terms of raw material cost. The second coarse crushing unit 29 overlaps with the chute 122 when viewed in the z direction as illustrated in FIG. 5. Therefore, the coarse crushed pieces M2' produced as described above naturally fall into the chute 122 to be supplied to the defibrating unit 13.

As explained above, the sheet manufacturing apparatus 100 includes the second coarse crushing unit 29, which includes the second coarse crushing blades 291 configured to rotate, and coarsely crushes the sheet S' that is the extra portion cut off by the second cutting portion 212. Therefore, it is possible to reuse, as the raw material, the extra portion of the sheet S produced due to size adjustment.

The first coarse crushing unit 12 overlaps with the chute 122 when viewed in the z direction. Since the chute 122 is shared by the first coarse crushing unit 12 and the second coarse crushing unit 29, it is possible to make the number of parts smaller and thus make the size smaller as compared with a structure in which individual chutes are provided respectively.

The pair of first coarse crushing blades 121 of the first coarse crushing unit 12 and the pair of second coarse crushing blades 291 of the second coarse crushing unit 29 overlap with each other when viewed in the z direction. Namely, the first coarse crushing unit 12 and the second coarse crushing unit 29 overlap with each other at least partially when viewed in the z direction, that is, in the vertical direction. Because of this structure, even if the opening of the chute 122 is relatively small, it is possible to share the single chute 122 by the first coarse crushing unit 12 and the second coarse crushing unit 29. Therefore, it is possible to reduce the size of the chute 122, resulting in a reduction in the length of the sheet manufacturing apparatus 100 in the x direction.

The second cutting portion 212 includes the rotary blades 215 configured to rotate. Each of the rotation axis O215 of the rotary blade 215 and the rotation axis O291 of the second coarse crushing blade 291 is along the y axis. Therefore, the length direction of the sheet S' cut off by the second cutting portion 212 is substantially the same as the direction of insertion between the second coarse crushing blades 291. Therefore, the sheet S' cut off by the second cutting portion 212 directly goes to the second coarse crushing unit 29 to be coarsely crushed thereat. Therefore, the transition from the cutting process to the second coarse crushing process is smooth.

Instead of providing the second coarse crushing unit 29, the sheet S' cut off by the second cutting portion 212 may be guided to the first coarse crushing unit 12 and may be shredded thereat into the coarse crushed pieces M2'. This makes it possible to omit the second coarse crushing unit 29. The second cutting portion 212 includes the rotary blades 215 configured to rotate. Each of the rotation axis O215 of the rotary blade 215 and the rotation axis O121 of the first coarse crushing blade 121 is along the y axis. Therefore, the sheet S' cut off by the second cutting portion 212 is directly guided to go to the first coarse crushing unit 12 to be coarsely crushed thereat. Therefore, the transition from the cutting process to the second coarse crushing process is smooth.

The sheet S after the size adjustment into a desired length and a desired width by the cutting unit 21 is transported through the outlet port 52B of the casing 50 to the ejection unit 22. The ejection unit 22 is a section that performs an ejection process. As illustrated in FIG. 2, the ejection unit 22 includes a casing 220, a stock unit 221 that is provided inside the casing 220, a transportation mechanism 222, and an ejected sheet receiver tray 223 that is provided outside the casing 220, specifically, on the −x side.

The casing 220 is provided adjacently on the −x side with respect to the casing 50 and over, on the +z side, the casing 110 of the raw material supplying unit 11. The casing 220 is fixed to the external surface of the −x sidewall of the casing 50. The casing 220 has an inlet port 224 that is provided in its +x sidewall and an outlet port 225 that is provided in its −x sidewall. The sheet S cut by the cutting unit 21 goes out through the outlet port 52B of the casing 50 to go into the casing 220 through the inlet port 224. The sheet S is transported to the stock unit 221 or the ejected sheet receiver tray 223 by the transportation mechanism 222. The ejection unit 22 includes a non-illustrated switcher that performs switching regarding whether to transport the sheet S to the stock unit 221 or to the ejected sheet receiver tray 223, by the transportation mechanism 222.

In the present embodiment, the transportation mechanism 222 includes a plurality of rollers 226, some of which are provided on a transportation path going toward the stock unit 221, and the others of which are provided on a transportation path going toward the ejected sheet receiver tray 223.

The ejected sheet receiver tray 223 is a plate member provided on the −x side of the casing 220. The sheets S ejected through the outlet port 225 are held in a stacked state on the ejected sheet receiver tray 223.

Each unit included in the sheet manufacturing apparatus 100 described above is electrically coupled to the control unit 28. The operations of these units are controlled by the control unit 28.

The control unit 28 includes a CPU (central processing unit) 281 and a storage unit 282. The CPU 281 is able to, for example, perform various kinds of determination and give various kinds of instructions.

Various programs such as, for example, a program for manufacturing a sheet S are stored in the storage unit 282.

The control unit 28 may be built in the sheet manufacturing apparatus 100, or may be provided in an external device such as an external computer. The sheet manufacturing apparatus 100 may be connected to an external device via wired connection or wireless connection. The connection may be via a network such as the Internet.

The CPU 281 and the storage unit 282 may be integrated into a single unit. The CPU 281 may be built in the sheet manufacturing apparatus 100, and the storage unit 282 may be provided in an external device such as an external computer. The storage unit 282 may be built in the sheet manufacturing apparatus 100, and the CPU 281 may be provided in an external device such as an external computer.

Next, with reference to FIGS. 2 to 5, a positional relationship among the units of the sheet manufacturing apparatus 100 will now be explained. As illustrated in FIG. 2, the units of the sheet manufacturing apparatus 100 described above are housed inside the casing 50. In FIG. 2, main components only of the sheet manufacturing apparatus 100 are illustrated, and illustration of the others is omitted. The casing 50 includes a lower part 50A, which is located on the −z side, and an upper part 50B, which is located on the 4-z side. In FIG. 2, a virtual line K extending in the x direction is illustrated. The −z side with respect to the virtual line K is the lower part 50A. The +z side with respect to the virtual line K is the upper part 50B. That is, with the virtual line K defined as the boundary, the −z side is the lower part 50A, and the +z side is the upper part 50B.

The first coarse crushing unit 12, the second coarse crushing unit 29, the defibrating unit 13, the screening unit 14, and the mixing unit 17 are housed in the lower part 50A. The defibrating unit 13, the screening unit 14, and the mixing unit 17 are arranged in this order from the −x side. The defibrating unit 13 is located at a non-center position that is relatively on the −x side. The mixing unit 17 is located at a non-center position that is relatively on the +x side.

In the lower part 50A, the first coarse crushing unit 12 and the second coarse crushing unit 29 are provided on the +z side with respect to the defibrating unit 13. The first coarse crushing unit 12 and the second coarse crushing unit 29 are arranged in this order from the −x side.

The raw material supplying unit 11 is provided outside the casing 50 at a position corresponding to the lower part 50A. That is, the raw material supplying unit 11 is provided outside the casing 50 on the −x side with respect to the first coarse crushing unit 12 and the defibrating unit 13.

The deposition unit 30, the heating and pressing unit 20, and the cutting unit 21 are housed in the upper part 50B. The deposition unit 30, the heating and pressing unit 20, and the cutting unit 21 are arranged in this order from the +x side. The cutting unit 21 is located at a non-center position that is relatively on the −x side. The deposition unit 30 is located at a non-center position that is relatively on the +x side.

The ejection unit 22 is provided outside the casing 50 at a position corresponding to the upper part 50B. That is, the ejection unit 22 is provided outside the casing 50 on the −x side with respect to the cutting unit 21.

As explained above, in the sheet manufacturing apparatus 100, the raw material supplying unit 11 and the ejection unit 22 are provided on one side in the x direction with respect to the casing 50, specifically, on the −x side. The rotation axis O121 of the first coarse crushing blade 121 is along the y axis. The raw material supplying unit 11 is disposed on the −z side with respect to the ejection unit 22, that is, below the ejection unit 22 in the vertical direction. In addition, the first coarse crushing unit 12 is disposed on the −z side with respect to the cutting unit 21, that is, below the cutting unit 21 in the vertical direction.

In the sheet manufacturing apparatus 100 having the above structure, the raw material sheet M1 supplied from the raw material supplying unit 11 is supplied to the lower part 50A of the casing 50 first. In the lower part 50A, the raw material sheet M1 turns into the mixture M7 through processes performed by the first coarse crushing unit 12, the defibrating unit 13, the screening unit 14, and the mixing unit 17. The mixture M7 is transferred to the upper part 50B of the casing 50, and is formed into the sheet S through processes performed by the deposition unit 30, the heating and pressing unit 20, and the cutting unit 21. The sheet S formed goes out of the upper part 50B of the casing 50. Then, the sheet S having gone out of the casing 50 is ejected by the ejection unit 22. That is, the raw material sheet M1 is supplied from the −x side of the lower part 50A, is transferred to the upper part 50B at the +x side of the lower part 50A, and turns around thereat toward the −side. The sheet S goes out of the upper part 50B at the −x side. In other words, the raw material sheet M1 turns into the sheet S by being processed along the transportation path, the going part of which is the lower part 50A, and the returning part of which is the upper part 50B.

Since the transportation path of the raw material sheet M1 includes a turnaround in the middle, it is possible to make the overall length of the sheet manufacturing apparatus 100 shorter, that is, make the length in the x direction shorter, as compared with a structure of related art in which processes are performed along a one-directional transportation path from the −x side toward the +x side. Therefore, for example, even in a limited indoor space, the number of sites where the sheet manufacturing apparatus 100 can be installed increases, meaning easy installation of the sheet manufacturing apparatus 100 at various sites.

Moreover, since the going part of the transportation path and the returning part of the transportation path overlap each other in the z direction, it is possible to make the sheet manufacturing apparatus 100 narrower in width, that is, make the length in the y direction shorter, as compared with a structure in which the going part of the transportation path and the returning part of the transportation path overlap each other in the y direction. Therefore, it is easier to install the sheet manufacturing apparatus 100 at various sites.

As described above, the sheet manufacturing apparatus 100 includes: the raw material supplying unit 11 that supplies the raw material sheet M1 that contains fibers; the first coarse crushing unit 12 that includes the first coarse crushing blade 121 configured to rotate, and coarsely crushes the raw material sheet M1 supplied from the raw material supplying unit 11; the defibrating unit 13 that defibrates the coarse crushed pieces M2 produced by the first coarse crushing unit 12; the deposition unit 30 on which the defibrated material M3 produced by the defibrating unit 13 is deposited; the heating and pressing unit 20 that applies heat and pressure to the second web M8 that is a deposited material produced on the deposition unit 30 for forming into a sheet S; the cutting unit 21 that cuts the sheet S; and the ejection unit 22 that ejects the cut sheet S. When an x axis and a y axis which are orthogonal to each other and each of which is orthogonal to a vertical direction are set, the raw material supplying unit 11 and the ejection unit 22 are provided on one side in a direction of the x axis, that is, the x direction. The rotation axis of the first coarse crushing blade 121 is along the y axis. The raw material supplying unit 11 is disposed below the ejection unit 22 in the vertical direction, that is, on the −z side with respect to the ejection unit 22, and the first coarse crushing unit 12 is disposed below the cutting unit 21 in the vertical direction. This structure makes the overall length of the sheet manufacturing apparatus 100 shorter, that is, makes the length in the x direction shorter, as compared with a structure of related art. Moreover, it is possible to make the sheet manufacturing apparatus 100 narrower in width, that is, make the length in the y direction shorter. Therefore, it is easier to install the sheet manufacturing apparatus 100 at various sites.

As illustrated in FIG. 5, the raw material supplying unit 11 and the ejection unit 22 overlap with each other at least partially when viewed in the z direction. In the present embodiment, the raw material supplying unit 11 and the ejection unit 22 overlap with each other such that the raw material supplying unit 11 is entirely included in the area of the ejection unit 22. Because of this structure, as compared with a case where the raw material supplying unit 11 and the ejection unit 22 are installed side by side in the y direction, it is possible to make the sheet manufacturing apparatus 100 narrower in width, that is, make the length in the y direction shorter. Therefore, it is easier to install the sheet manufacturing apparatus 100 at various sites more efficiently.

It is unnecessary for the raw material supplying unit 11 and the ejection unit 22 to overlap with each other entirely when viewed in the z direction. The effects described above can be expected as long as they overlap with each other at least partially. Namely, even if the central axis O11 of the raw material supplying unit 11 and the central axis O22 of the ejection unit 22 are not in alignment in the y direction, the effects described above can be expected as long as there is an overlap between the raw material supplying unit 11 and the ejection unit 22. The central axis O11 is defined as a straight line that is parallel to the x direction and goes through the center of gravity of a projected shape when the raw material supplying unit 11 is projected in the z direction. The central axis O22 is defined as a straight line that is parallel to the x direction and goes through the center of gravity of a projected shape when the ejection unit 22 is projected in the z direction.

As explained above, the raw material supplying unit 11 and the ejection unit 22 overlap with each other at least partially when viewed in the z direction, that is, in the vertical direction. Therefore, it is easier to install the sheet manufacturing apparatus 100 at various sites more efficiently.

As described earlier, the sheet manufacturing apparatus 100 includes the casing 50 that houses the first coarse crushing unit 12, the defibrating unit 13, the heating and pressing unit 20, and the cutting unit 21. Therefore, it is possible to protect these units.

The deposition unit 30 is disposed in the upper part 50B of the casing 50, and the defibrating unit 13 is disposed in the lower part 50A of the casing 50. Because of this arrangement, as described earlier, the raw material sheet M1 turns into the sheet S by being processed along the path going toward the +x side in the lower part 50A, next, turning around, and then going toward the −x side in the upper part 50B. Therefore, the effects described above can be expected more reliably.

As illustrated in FIG. 2, there is an overlap in terms of position in the x direction between the cutting unit 21 and the first coarse crushing unit 12 when viewed in the y direction. In other words, the cutting unit 21 and the first coarse crushing unit 12 overlap with each other at least partially when viewed in the vertical direction. Therefore, it is possible to make the position of the start point of the going part of the transportation path equal to the position of the end point of the returning part of the transportation path as much as possible inside the casing 50. Therefore, it is possible to further reduce the length of the sheet manufacturing apparatus 100 in the x direction.

As illustrated in FIG. 5, the casing 50 includes an access port 51, an access port 52, an open/close door 53 for opening and closing the access port 51, and an open/close door 54 for opening and closing the access port 52.

The access port 51 is an opening that is provided in the +y sidewall 55 of the casing 50. The access port 52 is an opening that is provided in the −y sidewall 56 of the casing 50. Each of the open/close door 53 and the open/close door 54 has a so-called side-by-side double-doored structure that includes two rotatable board members. By opening and closing the open/close door 53 or the open/close door 54, it is possible to open and close the access port 51 or the access port 52, thereby accessing the inside of the casing 50. Therefore, for example, it is possible to perform internal inspection, maintenance, and the like.

With the structure described above, for example, even if the sheet manufacturing apparatus 100 is installed such that the access port 51 of the casing 50 faces a wall or the like, the inside can be accessed via the access port 52. Even if the sheet manufacturing apparatus 100 is installed such that the access port 52 of the casing 50 faces a wall or the like, the inside can be accessed via the access port 51. Moreover, even if the sheet manufacturing apparatus 100 is installed such that the +x sidewall 57 of the casing 50 and either one of the sidewalls 55 and 56 thereof face walls or the like, the inside can be accessed via the access port of the other of the sidewalls 55 and 56. This is because, as described earlier, the raw material supplying unit 11 and the ejection unit 22 are provided on one side in the x direction, specifically, on the −x side. Therefore, the degree of freedom in the site of installation further increases.

Each of the open/close door 53 and the open/close door 54 may have a single-doored structure that includes one rotatable board member, or may have a slide door structure.

Although a sheet manufacturing apparatus according to the illustrated embodiment has been described above, the scope of the present disclosure is not limited to the foregoing examples. The units constituting the sheet manufacturing apparatus may be replaced with arbitrary alternatives that fulfill the same functions. Arbitrary components may be added.

What is claimed is:

1. A sheet manufacturing apparatus, comprising:

a raw material supplying section that supplies a raw material sheet that contains fibers;

a first coarse crushing section that includes a first coarse crushing blade configured to rotate, and coarsely crushes the raw material sheet supplied from the raw material supplying section;

a defibrating section that defibrates coarse crushed pieces produced by the first coarse crushing section;

a deposition section on which a defibrated material produced by the defibrating section is deposited;

a heating and pressing section that applies heat and pressure to a deposited material produced on the deposition section for forming into a sheet;

a cutting section that cuts the sheet;

an ejection section that ejects the cut sheet;

a casing including a lower part and an upper part overlapping each other when viewed in the vertical direction, the first coarse crushing section and the defibrating section being arranged in the lower part, the deposition section, the heating and pressing section and the cutting section being arranged in the upper part, wherein when an x axis and a y axis which are orthogonal to each other and each of which is orthogonal to a vertical direction are set, the raw material supplying section and the ejection section are provided on one side in a direction of the x axis, a rotation axis of the first coarse crushing blade is along the y axis, and the raw material supplying section is disposed below the ejection section in the vertical direction, and the first coarse crushing section is disposed below the cutting section in the vertical direction.

2. The sheet manufacturing apparatus according to claim 1, wherein the raw material supplying section and the ejection section overlap with each other at least partially when viewed in the vertical direction.

3. The sheet manufacturing apparatus according to claim 1, wherein the cutting section and the first coarse crushing section overlap with each other at least partially when viewed in the vertical direction.

4. The sheet manufacturing apparatus according to claim 1, wherein the cutting section includes a first cutting portion that cuts the sheet along a direction of they axis and a second cutting portion that cuts off an extra portion of the sheet along the direction of the x axis.

5. The sheet manufacturing apparatus according to claim 4, further comprising:

a second coarse crushing section that includes a second coarse crushing blade configured to rotate, and coarsely crushes the extra portion cut off by the second cutting portion.

6. The sheet manufacturing apparatus according to claim 5, wherein the first coarse crushing section and the second coarse crushing section overlap with each other at least partially when viewed in the vertical direction.

7. The sheet manufacturing apparatus according to claim 5, wherein the second cutting portion includes a rotary blade configured to rotate, and each of a rotation axis of the rotary blade and a rotation axis of the second coarse crushing blade is along the y axis.

8. The sheet manufacturing apparatus according to claim 1, wherein the x axis is parallel to a transport direction of the sheet in the heating and pressing section.

* * * * *